US006054921A

United States Patent [19]

Miller

[11] Patent Number: 6,054,921

[45] Date of Patent: Apr. 25, 2000

[54] ALARM FOR A ROLL SHUTTER ASSEMBLY

[76] Inventor: James V. Miller, 893 N. Maryknoll Cir., Glen Ellyn, Ill. 60137

[21] Appl. No.: 09/310,281

[22] Filed: May 12, 1999

[51] Int. Cl.[7] ..... G08B 13/02

[52] U.S. Cl. ..... 340/541; 340/545.1; 340/545.8; 340/550; 340/665

[58] Field of Search ..... 340/541, 545.1, 340/545.8, 550, 665

[56] References Cited

U.S. PATENT DOCUMENTS

| | | | |
|---|---|---|---|
| 3,462,885 | 8/1969 | Miller | 49/475.1 |
| 4,115,952 | 9/1978 | French | 49/26 |
| 4,143,367 | 3/1979 | Schestag | 340/540 |
| 4,262,176 | 4/1981 | Kapitza et al. | 200/61.43 |
| 5,438,798 | 8/1995 | Plamper et al. | 49/28 |
| 5,894,267 | 4/1999 | Blair | 340/541 |

*Primary Examiner*—Glen Swann
*Attorney, Agent, or Firm*—Marshall, O'Toole, Gerstein, Murray & Borun

[57] ABSTRACT

An alarmed roll shutter assembly includes a frame, a shutter that moves along the frame from a closed position to an open position, a pressure actuated sensor disposed in close proximity to the shutter and an alarm that detects actuation of the pressure actuated sensor to sound an alarm and/or turn on lights. The pressure actuated sensor may be disposed between the frame and the shutter when the shutter is in a closed position and is mounted to detect pressure caused by the shutter being forced against the frame at high pressure, such as pressure caused by placing a crowbar or other tool between the shutter and the frame and prying the shutter and frame apart.

33 Claims, 3 Drawing Sheets

ALARM FOR A ROLL SHUTTER ASSEMBLY

FIELD OF THE INVENTION

The invention relates generally to roll shutter assemblies and, more particularly, to alarms for roll shutter assemblies.

BACKGROUND OF THE INVENTION

Rolling protective shutter assemblies or roll shutter assemblies are used to cover windows, doors or other openings of buildings and the like to provide a measure of security from damage, break-in and theft at those locations. Roll shutter assemblies typically include a frame disposed around the opening, a shutter made up of a series of interconnected or hinged slats that travel within the frame and a shutter housing that stores the shutter in a rolled-up manner. The shutter, which is typically made of metal or other hard-to-compromise material, moves within one or more guides or tracks on the frame from an open position, in which the shutter is rolled up and stored within the shutter housing, to a closed position, in which the shutter is disposed over the opening, and vice-versa. Roll shutters may also include a mechanism, such as a hand crank or a motor, that moves the shutter within the tracks from the closed or extended position to the open or retracted position. Although roll shutter assemblies provide additional protection to openings, roll shutter assemblies are not completely immune from attacks by intruders who may compromise the integrity of the roll shutter assembly using saws to cut holes in a shutter or using crowbars or other devices to pry the slats of the shutter apart, pry the shutter out of the tracks and the like.

Common methods of alarming openings involve the use of contact assemblies that have a first electrical contact placed on, for example, a window or a door, and a second electrical contact placed on a stationary frame in which the window or door is mounted so that the first and second contacts touch when the window or door is closed. In some instances, an electrical strip or conductor may also be placed around the window or door to create an electrical circuit within the window or door. Whenever the electrical circuit is broken because, for example, the window or door is opened or is broken (thereby disconnecting the first and second contacts or breaking the electrical strip), the alarm activates.

However, unlike a window or a door, the shutter of a roll shutter assembly is somewhat flexible and is designed to roll in tracks or guides which typically have large tolerances. As a result, the shutters of roll shutter assemblies do not necessarily close at the exact same spot consistently, making it difficult to establish a reliable contact between the shutter and the frame. In addition, contact alarm systems can be overly sensitive to movement of the shutter. In fact, contact assemblies may be triggered by winds blowing against the shutter, bumps or other incidental contact made by passers-by and the like. As a result, contact assemblies used in other alarming applications cause an unacceptable number of false alarms when used with roll shutter assemblies. Still further, because the shutter of a roll shutter assembly is made of metal or other bendable material, the integrity of the shutter may be compromised without actually interrupting a circuit created by an electrical strip disposed around the edge of the shutter. For example, an alarm that has a conductor placed around the outer edge of the shutter may be defeated by simply cutting a hole through the center of the shutter.

To avoid the problems of false alarms, roll shutter assemblies may be installed on the inside, as opposed to the outside, of openings. While this configuration reduces the problem of false alarms, the level of protection offered by the shutter is also reduced because an intruder can still damage a window, for example, before encountering the protective shutter assembly.

SUMMARY OF THE INVENTION

An alarmed roll shutter assembly includes a frame, a shutter that moves along the frame from a closed position to an open position, a pressure actuated sensor disposed in close proximity to the shutter and an alarm that detects actuation of the pressure actuated sensor and that operates, for example, to sound a siren and/or turn on lights. The pressure actuated sensor may be disposed on the frame of the assembly so that the sensor is in close proximity to the shutter when the shutter is in the closed or a partially closed position. Preferably, the sensor is mounted to detect pressure caused by the shutter being forced against the frame at high pressure, such as pressure incident to break-ins by a crowbar or other tool being placed between the shutter and the frame and being used to pry the shutter and frame apart.

If desired, the pressure actuated sensor may be a vacuum device or may be one or more strips of contact tape having a first conductor, a second conductor and a bridgeable gap disposed between the first and second conductors. The contact tape may have a raised member or ridge disposed over the bridgeable gap and, in response to pressure being applied to the contact tape, this ridge may cause the first electrical conductor to move through the bridgeable gap to contact the second electrical conductor.

DESCRIPTION OF THE PREFERRED EMBODIMENTS

Figure 1:
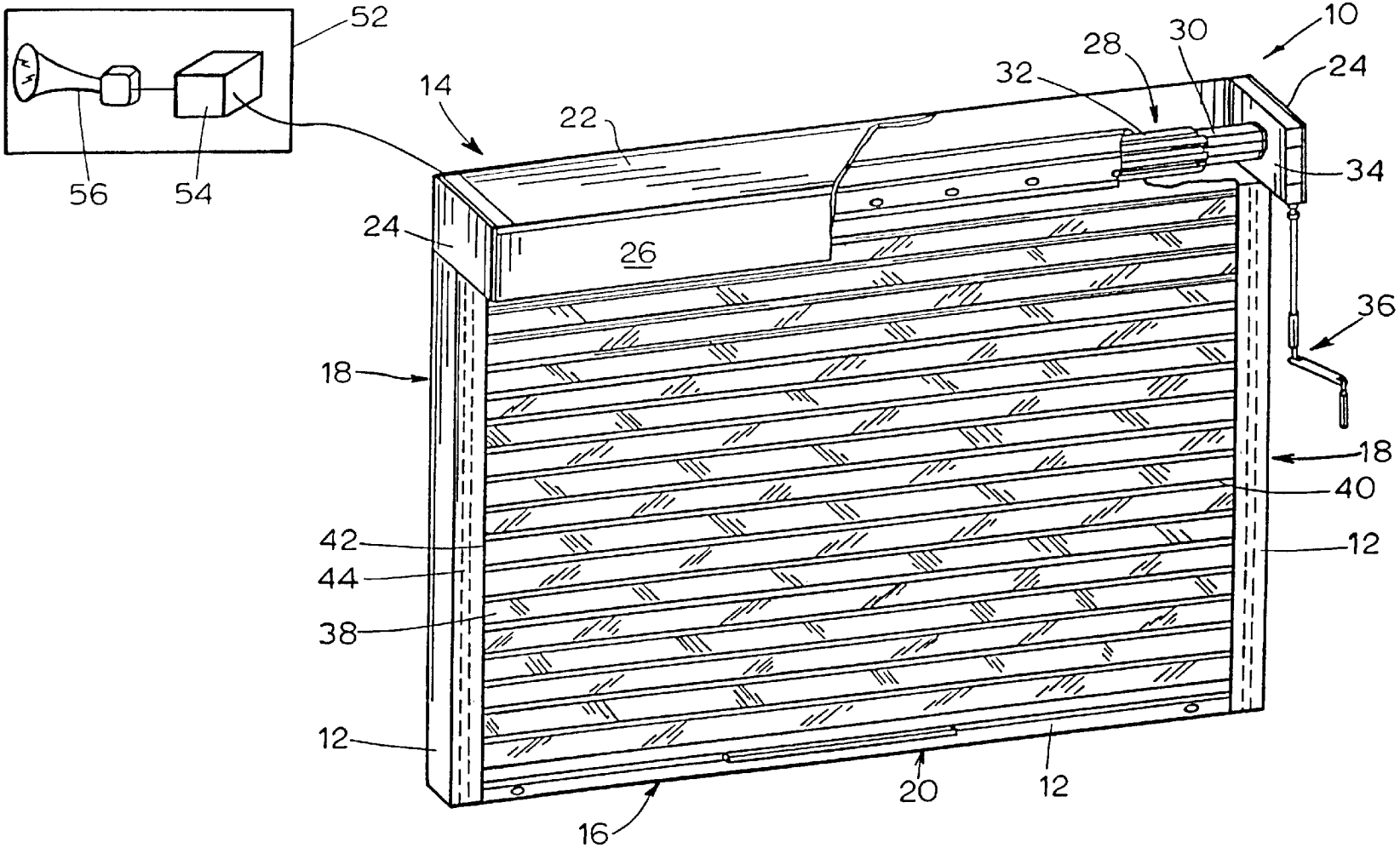
FIG. 1 is a perspective, partial cut-away view of an alarmed roll shutter assembly having a shutter in a closed position.

Referring to FIG. 1, an alarmed roll shutter assembly 10 may be used to protect windows, doors or other openings of buildings, cars, trucks or any other desired structure. The roll shutter assembly 10 includes a frame 12 and a rolling shutter 16 disposed within the frame 12. The frame 12 has a shutter housing 14, side enclosures 18 and, in some cases, a bottom member 20 upon which the shutter is closed. In other cases, the bottom member 20 is omitted and the rolling shutter 16 closes on or contacts a surface such as the ground or pavement. In the embodiment illustrated in FIG. 1, the shutter housing 14 is a shutter storage compartment including a top wall 22, a pair of side walls 24, a front wall 26 and a shutter support member 28 rotatably mounted to the side walls 24. The support member 28 includes a generally cylindrical central shaft 30 and a plurality of mounting members 32 fixed to the central shaft 30 which is connected to and adapted to receive the rolling shutter 16. The roll shutter assembly 10 also has a gearbox 34 which interconnects the shaft 30 to a handle 36, via a conventional gear assembly (not shown).

The rolling shutter 16 includes a plurality of individual, elongated slats 38. each of which is generally flat, having two substantially planar and opposing side portions. The slats 38, which may be made of, for example, steel or other metal, hard plastic, or any other hard-to-compromise material, are interconnected by hinges 40. Ends 42 of the slats 38 are disposed within a pair of shutter guides or tracks 44 mounted to the frame 12. When mounted to protect a window or a door of a building. the shutter tracks 44 of the roll shutter assembly 10 are typically positioned on either side of the window or door and the shutter housing 14 is typically positioned over the top of the window or the door.

Figure 2:
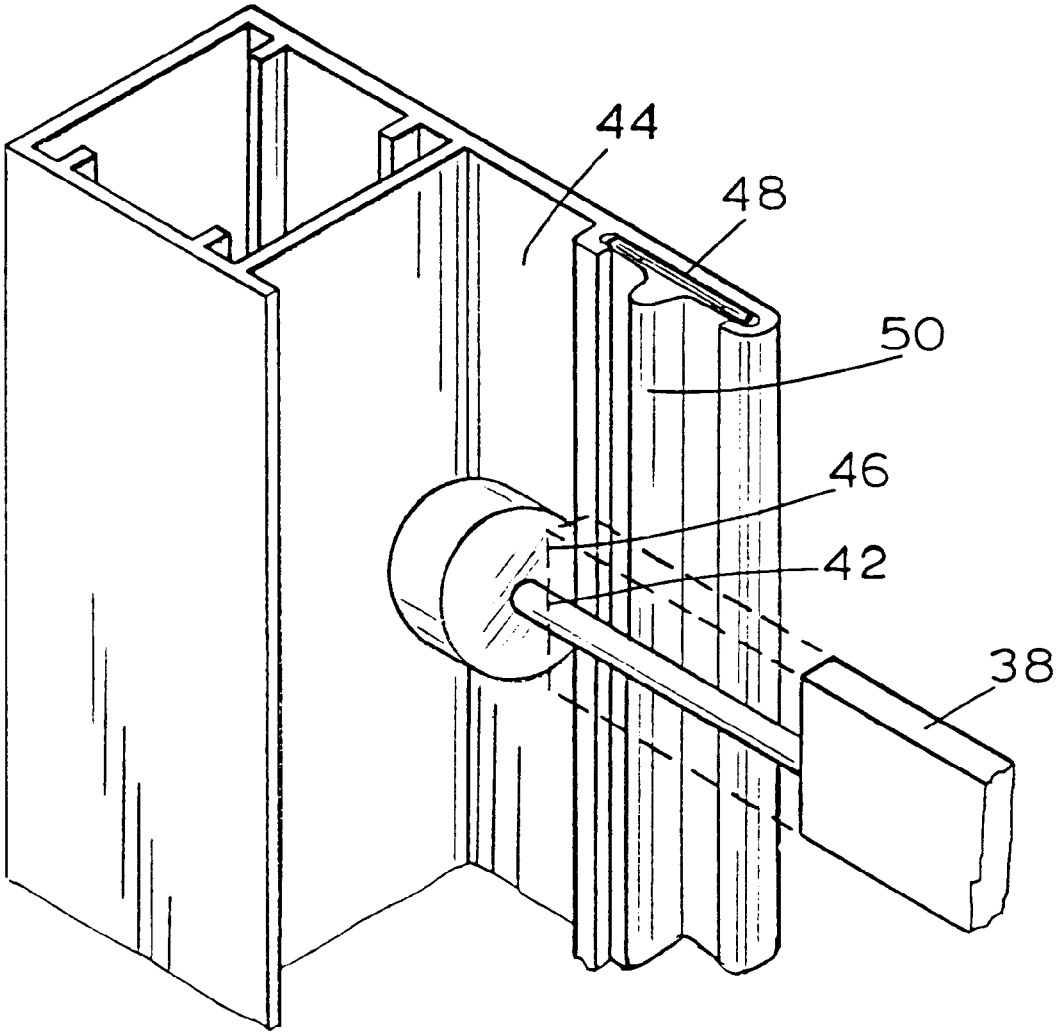
FIG. 2 is a cross-sectional view of a first embodiment of a pressure actuated sensor used in the roll shutter assembly of FIG. 1.

When the rolling shutter 16 is not in use, it is rolled up on the shutter support member 28 using the handle 36 so that the shutter 16 is at least partially disposed in the shutter housing 14. The handle 36 may be disposed on a rear portion of the roll shutter assembly 10 so that the rolling shutter 16, when used with a window for example, can be unrolled from inside the window. As illustrated in FIG. 2. the tracks 44 accept a wheel 46 connected to the one of the slats 38 and maintains the movement of the rolling shutter 16 along the frame 12.

As illustrated in FIG. 1 and 2, the frame 12 also includes an alarm channel 48 that holds a pressure actuated sensor 50 in place along the length of the frame 12 so that the pressure actuated sensor 50 is disposed between the frame 12 and the ends of the rolling shutter 42. During normal operation, the slats 38 move in the track 44 and glide along or slide in close proximity to the pressure actuated sensor 50 without actuating the sensor 50.

As illustrated in FIG. 1, an alarm 52 is communicatively coupled to the pressure actuated sensor 50 and includes an alarm unit 54 that senses when the pressure actuated sensor 50 is actuated. When the alarm unit 54 senses actuation of the pressure actuated sensor 50, the alarm unit 54 causes an alarm bell or siren 56 to sound. Alternatively or in addition, the alarm unit 54 may turn on lights, call the police or take any other desired action upon detecting actuation of pressure actuated sensor 50. The alarm unit 54 may be any desired commercially available alarm unit or an alarm unit dedicated for use with the roll shutter 16.

During operation, i.e., when the alarm unit 54 is turned on, bending or pulling on the rolling shutter 16 or slats 38 causes the slats 38 to bend or bow, thereby causing the ends 42 of the slats 38 to exert pressure or force on the pressure actuated sensor 50 which, in turn, causes activation of the siren 56. For example, when an intruder tries to pry the rolling shutter 16 out of the tracks 44 using, for example, a crowbar or other instrument, the crowbar will likely be placed or inserted between the rolling shutter 16 and the tracks 44 of the frame 12 and thus, between the pressure actuated sensor 50 and the rolling shutter 16. Thereafter, when pressure is applied by the crowbar to force the rolling shutter 16 away from the tracks 44, this pressure will be transmitted to the pressure actuated sensor 50 causing it to be actuated. Similarly, if a tool such as an axe or crowbar is forced through the rolling shutter 16 in, for example, the center of the shutter 16, the force attendant to this action will cause the shutter slats 38 to be forced against the pressure actuated sensor 50 thereby actuating the sensor 50.

The pressure actuated sensor 50 may be placed at any place adjacent or in close proximity to the rolling shutter 16 to detect break-ins or unauthorized entry attempts. As illustrated in FIG. 1 and FIG. 2, the pressure activated sensor 50 is preferably disposed between the track 44 and the inner edge of the frame 12 to maximize the likelihood that the sensor 50 will be actuated when pressure incident to an unauthorized entry is applied to the slats 38 or to the frame 12. However, the pressure activated sensor 50 may be placed anywhere else within the frame 12 including on the back side of the rolling shutter 16, or on the sides of the slats 38. Likewise the pressure activated sensor 50 may be disposed on the frame 12 both in front and back of the rolling shutter 16 and/or on both sides of the frame 12, i.e. near each of the tracks 44. Preferably, the pressure actuated sensor 50 is disposed along the entire height of the frame 12 to be activated when any one of the slats 38 is deformed or moved under pressure incident to unauthorized entry. While the pressure actuated sensor 50 is preferably attached to the frame 12, it may instead be attached to the rolling shutter 16.

The pressure actuated sensor 50 is configured so that it will not activate in response to normal disturbances such as incidental contact, wind gusts and the like acting on the shutter 16. However, the pressure actuated sensor 50 is sensitive enough to detect disturbances incident to unauthorized entry such as an intruder's attempt to remove, bend or damage a slat 38 by, for example, pulling or prying on the slat 38 with a crowbar, cutting the slat 38 and the like.

Figure 3:
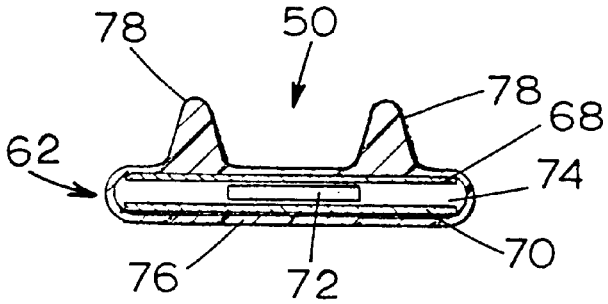
FIG. 3 is a cross-sectional view of a second embodiment of a pressure actuated sensor used in the roll shutter assembly of FIG. 1.

The pressure actuated sensor 50 may be any desired type of pressure actuated sensor and it is not to be limited by the specific sensors described herein. In one embodiment as illustrated in FIG. 3 the pressure actuated sensor 50 is contact tape 62 having a first electrical conductor 68 and a second electrical conductor 70 separated by an insulating material 72. The insulating material 72 is disposed between the first and second electrical conductors 68 and 70 so as to create a bridgeable gap 74 therebetween. An insulating cover 76 with a ridge or raised member 78 disposed thereon encases the first and second electrical conductors 68 and 70. The contact tape 62 is placed so that the ridge 78 is disposed toward the expected source of pressure and, when pressure is applied to the ridge 78, such as by one of the slats 38 or by a crowbar, the ridge 78 transfers the pressure to the first electrical conductor 68 over the bridgeable gap 74. The first electrical conductor 68 deforms or bends and travels through the bridgeable gap coming into electrical contact with the second electrical conductor 70. The alarm unit 54 may detect a short circuit between the first conductor 68 and second conductor 70 to detect actuation of the sensor 50.

The first conductor 68 and the second conductor 70 can be made of any desired conductive material. However, because a contact across the bridgeable gap 74 needs to be created to actuate the sensor 50, the first conductor 68 and second conductor 70 are made preferably of a material such as copper which is flexible enough to bend so as to move through the bridgeable gap 74 to make contact but resilient enough to return to its original shape and position after being pressed together across the bridgeable gap 74. Furthermore, conductors 68 and 70 are stiff enough so that they do not bend and connect across the bridgeable gap 74 under pressure normally experienced by the roll shutter assembly 10 such as wind gusts and incidental contact to the shutters 16. The first and second electrical conductors 68 and 70 can be a variety of shapes as long as they are flexible enough to make contact across the bridgeable gap 74 but rigid enough to retain their shape after numerous uses. In one embodiment, the first conductor 68 and second conductor 70 are flat. One type of contact tape that may be used as the sensor 50 is manufactured by Tapeswitch.

The insulating material 72 can be placed in a variety of places between the first conductor 68 and second conductor 70. For example, FIG. 3 illustrates a pressure actuated sensor 68 having a single, centered insulator 72 and two contact ridges 78 disposed above two bridgeable gaps 74 created on either side of the insulator 72. Likewise, the insulating cover 76 can be made of any desired type of insulating material and preferably is flexible enough to bend or flex in response to pressure incident to an unauthorized entry.

Figure 4:
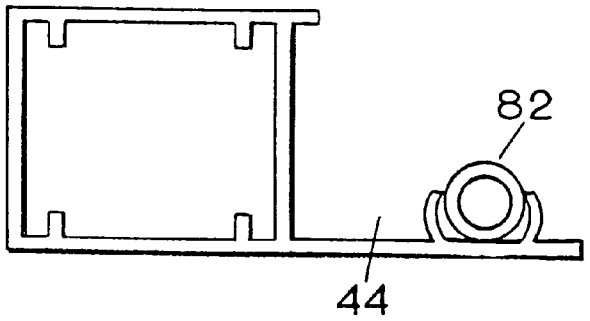
FIG. 4 is a cross-sectional view of a third embodiment of a pressure actuated sensor used in the roll shutter assembly of FIG. 1.

Referring to FIG. 4. another embodiment of the pressure actuated sensor 50 includes one or more vacuum devices 82 which may be disposed, for example, lengthwise along the track 44. In one embodiment, the vacuum device 82 is a malleable vacuum tube. The vacuum device 82 can be of any desired shape and made from any desired material. However, the vacuum device 82 should be flexible enough to detect pressure incident to an unauthorized entry applied thereto in the same manner as discussed above with respect to the pressure actuated sensor 50 of FIGS. 1 and 2, but stiff enough to withstand normal pressure from inclement weather and minor disturbances to the slats 38. When the pressure actuated sensor is compressed the pressure inside the vacuum device increases which is detected by an alarm unit 54. Although the vacuum device 82 is illustrated in FIG. 4 as being circular in cross section, it may, instead, be any other desired shape as long as it can properly sense pressure incident to an unauthorized entry.

Figure 5:
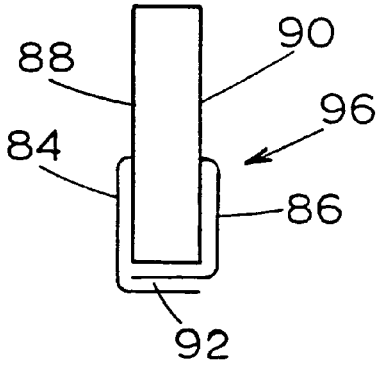
FIG. 5 is a side view of a fourth embodiment of a pressure actuated sensor disposed on a shutter of the roll shutter assembly of FIG. 1.

Referring to FIG. 5. in another embodiment of the alarmed roll shutter assembly 10. a pressure actuated sensor 96 may be used to detect break-ins such as those in which a crowbar or other tool is placed between the rolling shutter 16 and the ground or the bottom member 20 and is used to pry up on the shutter 16. The pressure actuated sensor 96 has a first conductor 84 attached to a front side 88 of a slat 38, and a second conductor 86 attached to a rear side 90 of the slat 38 which may be the bottommost slat 38 of the rolling shutter 16. Alternatively, the pressure activated sensor 96 is disposed between two slats 38. The first conductor 84 and the second conductor 86 are biased around the bottom of the slat 38, with the first conductor 84 and the second conductor 86 being disposed in overlapping proximity to each other, creating a bridgeable gap 92 between the first conductor 84 and the second conductor 86. The pressure actuated sensor 96 is activated when an intruder presses down on the shutter 16, causing the first and the second conductor 84 and 86 to contact each other or when an intruder places a crowbar or other tool under the slat 38 and forces the crowbar up, again causing the first and second electrical conductors 84 and 86 to come together.

Of course, persons of ordinary skill in the art will appreciate that the present invention is not limited to any particular environment of use and that the roll shutter assembly described herein can be used in any desired application without departing from the scope of the invention. Thus, while the present invention has been described with reference to specific examples, which are intended to be illustrative only and not to be limiting of the invention, it will be apparent to those of ordinary skill in the art that changes, additions or deletions may be made to the disclosed embodiments without departing from the spirit and scope of the invention.

What is claimed is:

1. A roll shutter assembly comprising:

a frame having first and second tracks and a storage compartment;

a shutter moveably disposed in the frame, wherein the shutter is moveable from an open position in which the shutter is disposed within the storage compartment to a closed position in which the shutter is disposed along the first and second tracks; and a pressure actuated sensor having at least a portion thereof disposed in close proximity to the shutter when the shutter is in the closed position to detect pressure applied to the frame or to the shutter incident to an unauthorized entry.

2. The roll shutter assembly of claim 1, wherein an alarm that detects actuation of the pressure actuated sensor is coupled to the pressure actuated sensor.

3. The roll shutter assembly of claim 1, wherein the pressure actuated sensor is disposed between the shutter and the frame when the shutter is in the closed position.

4. The roll shutter assembly of claim 1, wherein the pressure actuated sensor is disposed along a length of one of the first or second tracks.

5. The roll shutter assembly of claim 1, wherein the pressure actuated sensor includes a first electrical conductor, a second electrical conductor and a bridgeable gap between the first electrical conductor and the second electrical conductor, wherein the first electrical conductor is moveable through the bridgeable gap in response to the pressure applied to the frame or to the shutter incident to the unauthorized entry.

6. The roll shutter assembly of claim 5, wherein the pressure actuated sensor further includes an insulating material disposed between the first electrical conductor and the second electrical conductor.

7. The roll shutter assembly of claim 5, wherein the pressure actuated sensor includes a raised member disposed adjacent the first electrical conductor to transfer the pressure applied to the frame or to the shutter incident to an unauthorized entry to the first electrical conductor to thereby cause the first electrical conductor to move through the bridgeable gap to contact the second electrical conductor.

8. The roll shutter assembly of claim 7, wherein the raised member is disposed between the first electrical conductor and the shutter when the shutter is disposed in the closed position.

9. The roll shutter assembly of claim 1, wherein the pressure actuated sensor is contact tape.

10. The roll shutter assembly of claim 1, wherein the pressure actuated sensor includes a first sensor portion disposed adjacent the first track and a second sensor portion disposed adjacent the second track.

11. The roll shutter assembly of claim 1, wherein the shutter includes first and second opposing sides and a transverse side connecting the first and second opposing sides and wherein the pressure actuated sensor includes a first electrical conductor disposed adjacent the transverse side, a second electrical conductor disposed apart from the transverse side so that the first electrical conductor is disposed between the second electrical conductor and the transverse side and so that a bridgeable gap exists between the first electrical conductor and the second electrical conductor.

12. The roll shutter assembly of claim 11, wherein the transverse side of the shutter is a bottom side of the shutter when the shutter is in the closed position.

13. The roll shutter assembly of claim 1, wherein the pressure actuated sensor is a vacuum device.

14. The roll shutter assembly of claim 13, wherein the vacuum device is a malleable vacuum tube.

15. The roll shutter assembly of claim 1, wherein the alarm includes a noise-making device and an activating device that activates the noise-making device when the pressure actuated sensor is actuated.

16. An alarm assembly adapted for use in a roll shutter assembly having a frame with first and second tracks and a storage compartment and having a shutter moveably disposed in the frame, wherein the shutter is moveable from an open position in which the shutter is disposed within the storage compartment to a closed position in which the shutter is disposed along the first and second tracks, the alarm assembly comprising;

a pressure actuated sensor disposed in close proximity to the shutter when the shutter is in the closed position to detect pressure applied to the shutter or to the frame incident to an unauthorized entry.

17. The alarm assembly of claim 16, wherein an alarm that detects actuation of the pressure actuated sensor is coupled to the pressure actuated sensor.

18. The alarm assembly of claim 16, wherein the pressure actuated sensor is disposed along a length of one of the first or second tracks.

19. The alarm assembly of claim 16, wherein the pressure actuated sensor includes a first electrical conductor, a second electrical conductor and a bridgeable gap between the first electrical conductor and the second electrical conductor, and wherein the first electrical conductor is moveable through the bridgeable gap in response to the pressure applied to the frame or to the shutter incident to an unauthorized entry.

20. The alarm assembly of claim 19, wherein the pressure actuated sensor includes a raised member disposed adjacent the first electrical conductor to transfer the pressure applied to the frame or to the shutter incident to an unauthorized entry to the first electrical conductor to cause the first electrical conductor to move through the bridgeable gap to contact the second electrical conductor.

21. The alarm assembly of claim 19, further including a support that fixes the pressure actuated sensor to the frame so that the raised member is disposed adjacent the shutter when the shutter is in the closed position.

22. The alarm assembly of claim 16, wherein the pressure actuated sensor is contact tape.

23. The alarm assembly of claim 16, wherein the pressure actuated sensor includes a first sensor portion disposed along the first track and a second sensor portion disposed along the second track.

24. The alarm assembly of claim 16, wherein the shutter includes first and second opposing sides and a transverse side connecting the first and second opposing sides and wherein the pressure actuated sensor includes a first electrical conductor disposed adjacent the transverse side, a second electrical conductor disposed apart from the transverse side so that the first electrical conductor is disposed between the second electrical conductor and the transverse side and so that the bridgeable gap exists between the first and second electrical conductors.

25. The alarm assembly of claim 16, wherein the pressure actuated sensor is a malleable vacuum tube.

26. The alarm assembly of claim 16, wherein the alarm includes a noise-making device and an activating device that activates the noise-making device when the pressure actuated sensor is actuated.

27. A method of alarming a roll shutter assembly having a frame with first and second tracks and a storage compartment and having a shutter moveably disposed in the frame, wherein the shutter is moveable from an open position in which the shutter is disposed within the storage compartment to a closed position in which the shutter is disposed along the first and second tracks, the method comprising the steps of:

placing a pressure actuated sensor on the roll shutter assembly so that the pressure actuated sensor is disposed in close proximity to the shutter when the shutter is in the closed position and such that the pressure actuated sensor detects pressure applied to the frame or to the shutter incident to an unauthorized entry; and connecting an alarm to the pressure actuated sensor to detect actuation of the pressure actuated sensor.

28. The method of claim 27, further including the step of placing the pressure actuated sensor so that the pressure actuated sensor is disposed between the frame and the shutter when the shutter is in the closed position.

29. The method of claim 27, further including the step of placing the pressure actuated sensor along the length of one of the first or second tracks.

30. The method of claim 27, further including the step of using as the pressure actuated sensor a device having a first electrical conductor, a second electrical conductor and a bridgeable gap disposed between the first electrical conductor and the second electrical conductor so that the first electrical conductor can move through the bridgeable gap in response to pressure applied to the frame or to the shutter incident to an unauthorized entry.

31. The method of claim 27, wherein the step of placing the pressure actuated sensor includes the step of fixing the pressure actuated sensor to the frame.

32. The method of claim 27, wherein the shutter includes first and second opposing sides and a transverse side connecting the first and second opposing sides and wherein the pressure actuated sensor includes a first electrical conductor disposed adjacent the transverse side and a second electrical conductor disposed apart from the transverse side so that the first electrical conductor is disposed between the second electrical conductor and the transverse side and so that a bridgeable gap exists between the first and second electrical conductors.

33. The method of claim 27, further including the step of using a vacuum device as the pressure actuated sensor.

* * * * *